United States Patent [19]

Fahrig et al.

[11] 4,042,489

[45] Aug. 16, 1977

[54] METHOD FOR REDUCING CATALYST PARTICLE EMISSIONS IN FLUIDIZED CATALYTIC CRACKING PROCESSING

[75] Inventors: Robert J. Fahrig, Lansing; Terry W. Timm, Libertyville, both of Ill.

[73] Assignee: Standard Oil Company, Chicago, Ill.

[21] Appl. No.: 719,891

[22] Filed: Sept. 2, 1976

[51] Int. Cl.[2] ..... C10G 11/18

[52] U.S. Cl. ..... 208/152; 208/162; 210/65

[58] Field of Search ..... 208/152, 162

[56] References Cited

U.S. PATENT DOCUMENTS

| | | | |
|---|---|---|---|
| 2,879,224 | 3/1959 | Lawson | 208/162 |
| 2,906,704 | 9/1959 | Draeger et al. | 208/162 |

*Primary Examiner*—Herbert Levine

*Attorney, Agent, or Firm*—Arthur G. Gilkes; William T. McClain

[57] ABSTRACT

An improvement in a process for catalytic cracking of hydrocarbon feedstocks which comprises reducing the emisssion of catalyst particles through a regenerator effluent gas by passing a catalyst-laden stream from a main column into a slurry settling zone where there is recovered a decanted oil from an upper portion of said zone and an oil (slurry and oil) of catalyst from a bottom portion of said slurry settler. The improvement comprises recycling at least a portion of the decanted oil from said zone to a lower portion of the zone so as to regulate the upward velocity of the oil in said zone to selectively reject through the decanted oil stream small catalyst particles (less than about 20 microns diameter), which if not rejected through the decanted oil stream, would be recycled back to a fluidized catalytic cracking reaction zone in the slurry oil stream and ultimately released to the atmosphere by the effluent gases from the regeneration zone.

7 Claims, 2 Drawing Figures

METHOD FOR REDUCING CATALYST PARTICLE EMISSIONS IN FLUIDIZED CATALYTIC CRACKING PROCESSING

BACKGROUND OF THE INVENTION

1. Field of the Invention

The field of art to which this invention pertains is the separation of solids from fluids, and more particularly, the separation of hydrocarbon oils from catalyst fine materials in a slurry settler specifically used in fluidized catalytic cracking processing of petroleum.

2. Description of the Prior Art

Several methods are currently available to control and reduce fluidized catalytic reaction unit regenerator stack catalyst particulate emissions to the atmosphere. These include the use of electrostatic precipitators, high efficiency external cyclones, and various dip leg withdrawal schemes. These devices are generally installed to recover catalyst particles ranging in size from about 0 to about 20 microns diameter. The efficiency of conventional internal regenerator cyclones is presently very high on large particles but in many instances suffers when trying to remove small particles (less than 20 microns diameter) from the regenerator off-gas vented to the atmosphere.

A well known alternate method to control rejection of catalyst fines in the regenerator effluent gas is to allow catalyst fines to escape from the reactor cyclones and pass into the main column or fractionation system. If 0 to 20 microns catalyst particles are rejected from the reactor-fractionator system, then losses of this size range material from the regenerator stack will be reduced, if not totally eliminated, since most of the catalyst fines are eventually removed from the process. This method of operation is quite common in the industry, being practiced by many refiners. Typically, to implement such a processing scheme, the fractionator bottoms slurry stream is withdrawn from the slurry setter and sent to tankage, with removal of the settled catalyst at scheduled intervals. The clarified oil from such settling tanks can be recycled to the catalytic cracking reaction zone or other processing.

Unfortunately, if reactor cyclone efficiencies are poor either by virtue of design or for mechanical reasons, the reactor catalyst losses are intolerably high and rejection of particles appreciably larger than 20 microns occurs. Many catalytic cracking units are therefore equipped with slurry settling vessels to recover and recycle catalyst back into the reactor system.

The present inventive concept allows the use of a slurry settling zone but requires that at least a portion of the decanted oil from an uppermost portion of this slurry settling zone be eventually recycled to a lower portion of the slurry settling zone under some control mechanism to regulate the upward velocity of the oil in the slurry settling zone to selectively remove the catalyst particles of less than about 20 microns diameter. By selectively regulating the upward velocity of oil in the slurry settler by the recycle of decanted or clarified oil to the slurry settler, the size of catalyst particles being removed from the system can be closely regulated. This will minimize stack emissions frm the fluidized catalytic cracking regeneration effluent gases while also minimizing the total catalyst loss from the overall process.

U.S. Pat. No. 2,879,224 to S. D. Lawson, which issued Mar. 24, 1959, is considered to be the most relevant art that Applicants and their attorney have reviewed.

This patent relates to the separation of solids from fluids in a settling zone and requires that a low-coking fluid displace a high-coking fluid in a catalyst fines slurry mixture which mixture is then recycled to a fluidized catalytic cracking unit. A fluid is pumped into the settling zone at a regulated rate to allow the displacement of the high-coking fluid through the use of the low-coking fluid while still allowing settling, in a downward direction, of catalyst particles which are ultimately recycled to the cracking reaction zone.

SUMMARY OF THE INVENTION

The present invention can generally be summarized as a process improvement in a fluidized catalytic cracking process, wherein a catalyst-laden stream passes into a fractionating column which comprises passing a high boiling bottom stream from said fractionating column to a settling zone from which is recovered an overhead decanted oil stream and a bottoms slurry oil stream which contains at least a portion of said entrained catalyst, whereby at least a portion of said decanted oil from said settling zone is recycled to said settling zone at conditions which include the regulation of the rate of upward flow of liquid in said settling zone so as to reject from an upper portion of said settling zone via the decanted oil stream catalyst particles of less than about 20 microns diameters.

Figure 1:
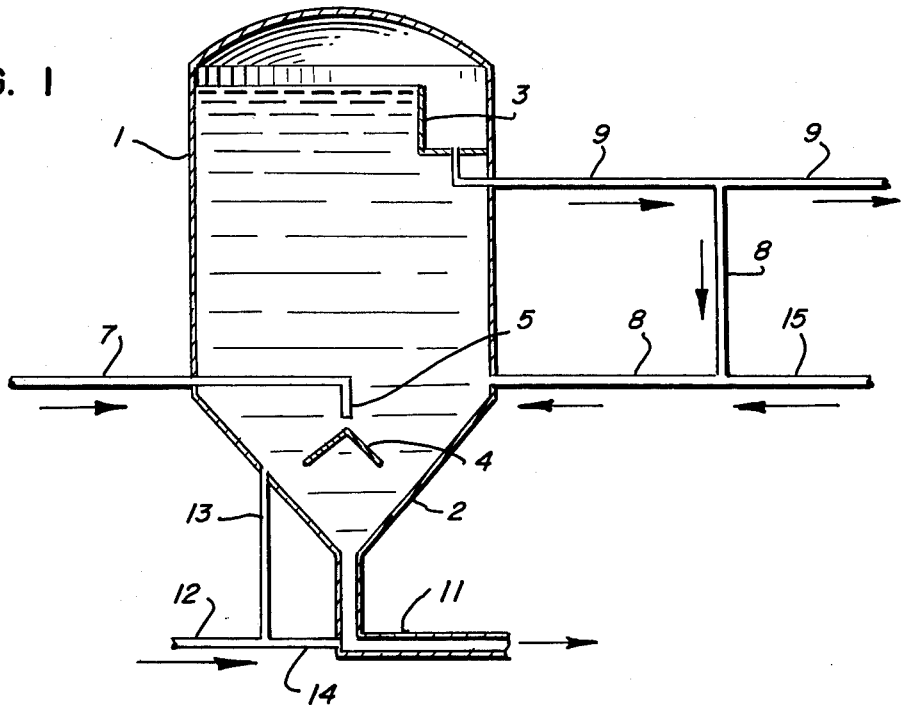
FIG. 1 illustrates a specific embodiment of the equipment utilizing the process of this invention.

Specifically, a slurry settling vessel or slurry settler 1 is shown having a diminishing diameter at its lowermost portion as illustrated by cone 2. Leaving the bottom of the slurry settler 1 via line 11 is a slurry-oil mixture which is preferably recycled to the catalytic cracking reaction zone and referred to as a slurry-oil recycle mixture. In most preferred instances all of the slurry oil passing through line 11 is combined with fresh feed and passed into a catalytic cracking reaction zone for further reaction to more valuable product materials.

In slurry settler 1 there is shown an outlet nozzle 5 which is connected to line 7. Through line 7 flows a main column or fractionating column bottoms stream which contains catalyst particles varying in size from fines (0–20 microns) to relatively large particles, the latter eventually recycled to the cracking reaction zone. Material flowing through line 7 is preferably the bottom portion from the main fractionating column in the fluidized catalytic cracking operations. In some instances this stream may also contain other streams which may contain catalyst or materials desired to be settled out.

Weir 3 is shown at the top of the slurry settler vessel. The weir allows a clarified oil, generally referred to as a decanted oil, to overflow the vertical wall and pass into the bottom of the weir for removal via line 9. Line 9 carries the clarified oil which can be sent to storage or used for other processing. At least a portion of the clarified oil (from line 9 or other sources) is recycled via line 18 to a lower portion of the slurry settler at a regulated flow rate so that the upward superficial velocity of the liquid in the slurry vessel is such that it preferably will allow the suspended catalyst particles having diameters from a few to about 20 microns to flow in an upward direction while the heavy catalyst particles settle out. The catalyst fines are rejected in the clarified oil which is removed via line 9 from the process.

Within the slurry settler 1 there is shown a deflecting cap 4 which can be used to distribute the flow of the main column bottoms material flowing into the slurry settler through line 7 evenly over the lower portion of the slurry settler 1.

In normal operations, the bottoms material from the main column in the fluidized catalytic cracking reaction section, passes via line 7 and through outlet nozzle 5 into a lower portion of the slurry settler 1. Heavy particles, that is particles having particle size of greater than about 20 microns, are allowed to flow together with a portion of the oil passing into the slurry settler in a general downward direction to ultimately be recovered at the bottom of cone 2 via line 11. Essentially all of the slurry oil which is recovered from the bottom of the slurry settler 1 is recycled via line 11 to be admixed with the fresh feed and passed into the reactor of the fluidized catalytic cracking unit. When operating at desired conditions, the material flowing over weir 3 and being recovered via line 9 is essentially a clarified oil referred to as decanted oil and when the process claimed herein is functioning properly, this decanted oil will contain essentially catalyst particles of less than about 20 microns diameter. The heavier catalyst particles settle to the bottom of the slurry settler 1 and recovered via line 11 before further processing.

Preferably at least a portion of the decanted oil flowing through line 9 is diverted via recycle line 8 into a lower portion of a slurry settler and at a regulated rate so as to control the upward velocity of the material flowing in the slurry settler for the aforementioned purposes. The portion of the decanted oil not recycled to the slurry settler is recovered via line 9 and used for further processing or sent to a second settling vessel where it can be stored for a period of time so as to allow catalyst particles of less than 20 microns diameter to be recovered from the bottom of the second settling vessel. In such instances, the decanted or clarified oil from the second settling vessel will contain very little, if any, suspended catalyst particles and can be used as a feed stock for further refinery processing or directly as fuel oil.

It is not necessarily required that a recycle decanted oil be passed as a separate line into the slurry settler vessel 1. In some instances the decanted oil recycle stream may be combined with feed passing through line 7. In such instances, the same regulation of the volume and flow rate of recycled decanted oil passing into the slurry settler will control the exact particle size of material which is ultimately recovered through the top portion via line 9 of the slurry settler 1.

It may be necessary to employ a dilution oil, which generally can be a heavy cycle oil or fresh feed, which is passed into the bottom of slurry settler 1 via lines 13 or 14, or both. When the contents in the bottom section of the slurry settler become very thick and difficult to remove, it may be necessary to dilute these products so they may be pumped and removed from the slurry settler. In such instances, a heavy cycle oil or some other dilution oil can pass through line 12 and thereafter be directed through either lines 13 or 14, or both, into various of the lower portions of the slurry settler.

DESCRIPTION OF THE PREFERRED EMBODIMENTS

A preferred embodiment of this invention resides in a process for fluidized catalytic cracking wherein feed and a finely divided catalyst are contacted in a reaction zone at fluidized catalytic cracking conditions to effect formation of cracked products, wherein cracked products containing entrained catalyst are separated from spent catalyst and passed into a fractionation column wherein a high boiling bottoms stream from said column containing the entrained catalyst is passed into a settling zone from which is recovered an overhead decanted oil and a bottoms slurry oil stream the latter containing at least a portion of said entrained catalyst and which is recycled as a portion of the feed to the reaction zone, and where said spent catalyst is contacted at regeneration conditions with an oxygen-containing gas in a refrigeration zone to burn coke off said catalyst forming effluent regeneration gases wherein said improvement comprises reducing emission of catalyst fines from said effluent regeneration gases while minimizing total catalyst losses in the process by recycling to said settling zone at least a portion of said decanted oil at conditions including the regulation of the rate of recycle to maintain the upward velocity of oil in said settling zone at a rate so as to reject from said settling zone catalyst in said decanted oil stream particles of less than about 20 microns diameter.

In a more preferred embodiment, the high boiling bottoms stream from said column passes into a lower portion of said settling zone and the decanted oil is recovered from an upper portion of said settling zone with recycle of said decanted oil to a point in said settling zone below the decanted oil outlet from said zone and wherein a bottoms slurry-oil is recovered from a lowest portion of said settling zone.

These and other embodiments and objects of the present invention will be further illustrated upon a review of the remaining specification and claims herein.

In a normal fluidized catalytic cracking reaction process, a fresh feed stream together with a certain portion of recycle slurry-oil which contains oil and catalyst particles removed from the bottom of a slurry settling vessel are contacted with a finely divided fluidized catalyst in a riser reaction zone for production of cracked products. The cracked products together with finely divided catalyst eventually pass into cyclone separation means where the finely divided catalyst is separated from the cracked products. In many instances, a certain portion of the finely divided catalyst, generally the smaller particle diameter materials, is carried over with the cracked products into a fractionating column generally referred to as the main column in the fluidized catalytic cracking processing sequence. From the bottom of this fractionation column there is removed a high boiling bottoms cut material which contains essentially all of the catalyst which has been entrained in the feed to such fractionation column. The high boiling bottoms stream from the column is then passed into intermediate location in a catalyst settling zone (catalyst settling vessel). In such settling zone, the heavier and larger catalyst particles together with much of the oil passed into this zone eventually migrate to the bottom of this zone and are recovered and recycled as a slurry-oil admixed with fresh feed for further reaction in the cracking reaction zone.

From an upper portion of the settling zone, there is recovered a clarified or decanted oil which is substantially reduced in catalyst content by virtue of the settling which takes place in such zone. According to the process of this invention, at least a portion of this decanted oil is returned preferably to a lower portion of the settling zone. Regulation of the recycle of decanted oil occurs so that the upward regulated velocity of the liquid in the settling zone is sufficient to entrain only the smaller particle size catalyst, that is catalyst of less than about 20 microns which are eventually removed from the settling vessel and the overall process in the decanted oil.

The catalyst which has been separated from the reactor by the cyclones passes into a regeneration zone where it is contacted with an oxygen-containing gas stream, generally air, for combustion of carbonaceous materials which have been deposited on said catalyst through the catalytic cracking process. The combustibles burn on the catalyst producing an effluent gas which in many instances contains both carbon monoxide and carbon dioxide. In some instances the carbon monoxide may be after-burned to produce a regeneration zone effluent containing essentially no combustible materials. The regeneration zone effluent gas will, in many instances, contain portions of entrained catalyst and therefore it is required that the catalyst particles be recovered before this stream is vented to the atmosphere. The regeneration zone effluent gases are generally passed through separation means or the like to remove as much of the catalyst as possible before venting to the atmosphere.

It is very difficult through known techniques to remove the catalyst particles economically which vary in the range of from greater than about 0 to about 20 microns in diameter from the regeneration zone effluent gas.

Accordingly, therefore, to reduce the emission of catalyst particles of less than 20 microns, Applicants allow a carryover from the reaction vessel into the main column of most of the catalyst having particle size of less than about 20 microns. These particles can be rejected from the overall processing sequence via the decanted oil removed from the settling zone as described above, thereby reducing emissions of catalyst fines to the atmosphere through the regenerator effluent gases.

One of the additional benefits gained by controlled recycle of decanted oil in the settling zone is that the total catalyst losses from the overall process can be minimized. This occurs because the only catalyst particles removed from the process via the decanted oil stream are those which normally would be vented to the atmosphere. In instances in which the decanted oil withdrawn from the settling zone is not recycled there may not be sufficient residence time in the settling vessel to allow the smaller particles to be separated from the larger catalyst particles resulting in either high catalyst losses due to carryover in the decanted oil of large catalyst particles or high emissions of small catalyst particles via the regeneration zone effluent gases because the small catalyst particles are recycled back to the reaction zone in the slurry-oil.

By the use of the present invention, it is possible to both reduce the extent of emission catalyst particles of less than about 20 microns to the atmosphere while substantially minimizing the total catalyst loss for fluidized catalytic cracking process.

Figure 2:
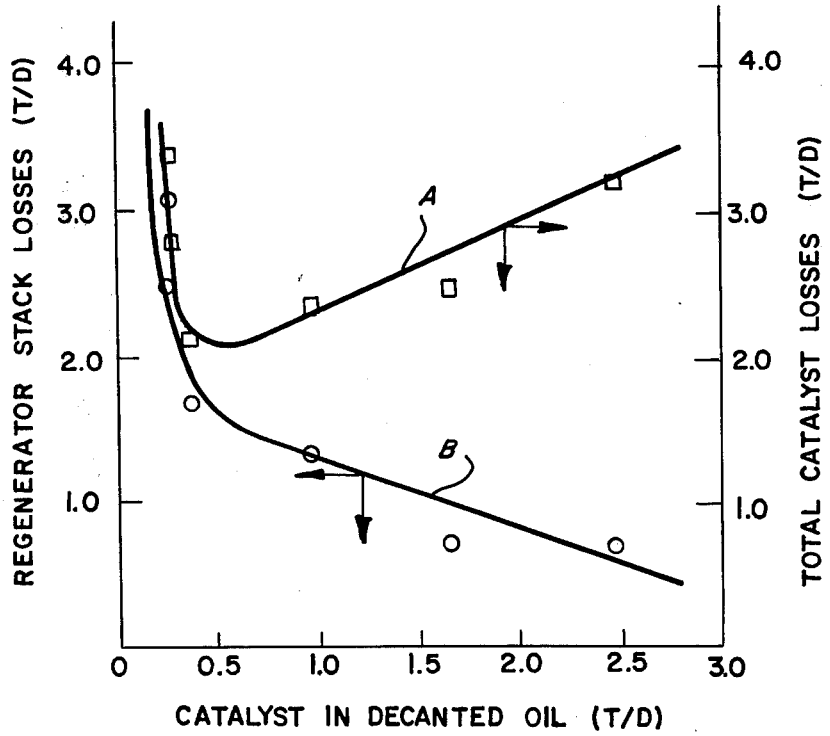

FIG. 2 shows the relationship between regenerator stack losses of catalyst particles and the overall total catalyst loss, both in tons per day, as a function of the catalyst which is removed from the overall process in a decanted oil stream. This Figure illustrates the operation of a fluidized catalytic cracking unit in which there was no recycle of decanted oil in the settling vessel.

Line A of FIG. 2 shows the relationship between the total catalyst losses (via both decanted oil stream and the regeneration zone effluent gas) and the catalyst losses via the decanted oil stream. As can be seen at some rate of catalyst withdrawal rate of the decanted oil stream (0.5 tons per day) there is a minimum of total catalyst loss. As Line A proceeds to the right, increasing amounts of catalyst in the decanted oil result in increases in total catalyst loss.

Line B represents the relationship between the amount of catalyst removed in tons per day in the decanted oil from the slurry settler and the regenerator stack losses of catalyst in tons per day. As the withdrawal rate of catalyst in the decanted oil increases, there is a sizable decrease in regenerator stack losses through the regenerator effluent gas of catalyst.

In combining the findings of both Lines A and B of FIG. 2 it can be shown that at some catalyst withdrawal rate through decanted oil removal there is a minimum of total catalyst loss from the process and a reduction of catalyst loss through the regenerator.

By utilizing a method of controlling the particle size of catalyst removed from the process via the decanted oil stream from the settling vessel, both a minimum of total catalyst losses and regenerator stack losses can be simultaneously met. The inventive concept disclosed herein offers such benefits through controlled regulation of the upward superficial velocity of liquid in the settling zone through recycle of decanted oil to the settling zone. By allowing sufficient recycle of decanted oil to the settling zone, the catalyst particles fed to the settling zone can be separated into a less than about 20 micron fraction which is rejected via the decanted oil stream. The heavier fraction catalyst particles (greater than about 20 microns particle size) are recovered via the slurry oil stream which is recycled to the cracking reaction zone.

In the operation of a normal slurry settler, a feed stream passes into the slurry settling vessel preferably at a point intermediate between an upper withdrawal stream for decanted oil and a lower withdrawal stream for the slurry-oil, the latter containing most of the catalyst. The feed to the settler, as is well known in the art, generally comprises the high boiling fraction from the main column or fractionating device which receives essentially all of the fluidized catalytic cracking zone reactor hydrocarbon effluent material. This material in normal operations will contain catalyst. It has been found during such operations that on the average about 50 per cent of the catalyst fed in the stream passing into the slurry settler contains catalyst fines, that is, material having particle size generally below about 20 microns. Therefore, in most instances, in order to reject this material at least half of the catalyst, in a preferable instance, passed into the settler should be rejected through the decanted oil stream if all or most of the catalyst particle size of less than 20 microns are to be rejected.

Typical slurry settler configurations are well known in the art and generally can comprise relatively large diameter cylindrical vessels into which a feed to the slurry settler is passed into a lower portion. Preferably, the bottom portion of the slurry settler is of a conical nature to minimize plugging. When a cone is used, the catalyst will slide down the cone and be recovered through the lowest portion at the apex of the cone and recycled to the reactor transfer line reaction zone. In some instances it is preferable to locate dilution oil inlets near the bottom of the slurry settler in order to unplug large masses of settled catalyst which may inhibit pumping of the slurry material from the bottom of slurry settler. The dilution oil can be any type oil available in a refinery and in many instances can include decanted oil or heavy cycle oil streams.

Preferably, the decanted oil is recovered from an uppermost portion of the slurry settler. In many instances a weir is internally located within the slurry settler so that oil within the settler can flow over the weir and be recovered for eventual recycle and removal from the slurry settler. In a preferable instance the decanted oil is recycled directly to the slurry settler. Recovered decanted oil, which contains the small fine catalyst particles, can be passed to storage for further settling or used in other processing known in the art. In some instances decanted oil from storage can be used as recycle to the settler. The term "decanted oil" can include the oil removed from the settler or the oil removed from a second settler or storage facility which receives the clarified oil from the first slurry settler.

The recycle of decanted oil is necessary in order to regulate the upflow superficial velocity within the catalyst slurry settler to reject the catalyst fines (less than 20 microns diameter) in the decanted oil while minimizing the carry over of catalyst particles greater than about 20 microns to reduce total catalyst losses. In this manner, essentially all of the fine catalyst particles can be removed from the process ultimately reducing generator stack emissions of catalyst fines and also minimizing the total catalyst losses for the overall process.

In one instance a certain portion of the decanted oil can be recycled and commingled with the feed to the slurry settler and recycled at a rate so as to regulate the upward flow of the liquid material in the slurry settler to reject essentially 0 to 20 micron particle size materials in the decanted oil stream. In other instances the recycle of decanted oil can come into the slurry settler below the feed point to said zone or above, depending upon the internal configuration of the slurry settler.

Typical slurry settlers depending upon the flow rate of material into them can vary anywhere from a few feet up to 20 or more feet in diameter and having heights anywhere from about a few feet up to 20 to 30 feet or more. A preferable design when using feed rates anywhere from about 7 to 10 thousand barrels per day of feed to a slurry settler is one that has an inside diameter of approximately 20 feet and an overall height from the feed inlet to the decanted oil outlet of about 17 feet.

The regulation of decanted oil recycle will vary depending upon the temperature of the materials passing into the slurry settling zone and their specific gravities. In one instance it has been found that regulation of the superficial upflow velocity above the feed point in the slurry settler at a rate anywhere around 0.44 inches per minute will allow a fairly good separation of catalyst fines from the remaining heavy catalyst particles which can be recovered via the slurry-oil line. The upflow velocity depends upon the quantity of catalyst, its particle size and distribution in the feed to the slurry settler, the specific gravity and temperature of the oil in such zone. Generally the superficial upflow velocity above the feed point in the slurry settler can be regulated anywhere from less than about 0.01 inch per minute up to as much as 1 to 2 inches per minute or higher. Preferred superficial upflow velocities are in the range of from about 0.1 to about 1 inch per minute, even more preferred superficial velocities are in the range of from about 0.2 to about 0.6 inches per minute.

Various percentages of the decanted oil coming out of the slurry settler can be recycled to the slurry settler to regulate the superficial upflow velocity in said settler so as to remove catalyst fines (less than 20 microns) while minimizing the loss of heavy catalyst particles (greater than 20 microns) from the slurry settler via the decanted oil stream. The ratio of recycle decanted oil to the slurry settler to decanted oil removed from the slurry settler loop can vary anywhere from less than 0.01 to 10 or more, depending upon the circumstances of operation in the slurry settling zone. In some instances the decanted oil recovered from the slurry settler may be passed into another settling zone with either the clarified oil or the slurry-oil from this zone used to supplement or as all of the recycle decanted oil to the slurry settling zone. It is preferable, however, to directly recycle decanted oil from the first slurry settler.

We claim as our invention:

1. In a process for fluidized catalytic cracking wherein feed and a finely divided catalyst are contacted in a reaction zone at fluidized cracking conditions to effect formation of cracked products, wherein cracked products containing entrained catalyst are separated from spent catalyst and passed into a fractionation column wherein a high boiling bottoms stream from said column containing said entrained catalyst is passed to a settling zone from which is recovered an overhead decanted oil and a bottoms slurry oil the latter containing at least a portion of said entrained catalyst wherein said slurry oil is recycled to the reaction zone, and where said spent catalyst is contacted at regeneration conditions with an oxygen containing gas in a regeneration zone to burn coke off said catalyst forming effluent regeneration gases wherein an improvement comprises reducing emission of catalyst fines from said effluent regeneration gases while minimizing total catalyst losses in the process by recycling to said settling zone at least a portion of said decanted oil at conditions including regulation of rate of recycle of decanted oil to maintain the upward velocity of fluid in said settling zone at a rate so as to reject from said settling zone in said decanted oil catalyst particles of less than about 20 microns diameter.

2. The process of claim 1 further characterized in that the entrained catalyst in said slurry oil has a particle size in excess of about 20 microns diameter

3. The process of claim 1 further characterized in that said upward velocity in said settling zone is from about 0.1 to about 1 inches per minute.

4. The process of claim 3 further characterized in that said upward velocity is from about 0.2 to about 0.6 inches per minute.

5. The process of claim 1 further characterized in that said bottoms slurry-oil is recovered from a lower portion of said settling zone, said decanted oil is recovered from an upper portion of said settling zone, and said high boiling bottoms stream and the decanted oil recycle pass into said settling zone at a location between said upper and lower portions.

6. In a process for fluidized catalytic cracking wherein feed and a finely divided catalyst are contacted in a reaction zone at fluidized cracking conditions to effect formation of cracked products, wherein cracked products containing entrained catalyst particles having particle sizes above and below 20 microns are separated from spent catalyst and passed into a fractionation column wherein a high boiling bottoms stream from said column containing said entrained catalyst is passed to a settling zone at a first point in said zone from which is recovered decanted oil from a point above said first point and a bottoms slurry-oil from a point below said first point said slurry-oil containing entrained catalyst particles of greater than about 20 microns, wherein said slurry oil is recycled to the reaction zone, and where said spent catalyst is contacted at regeneration conditions with an oxygen-containing gas in a regeneration zone to burn coke off said catalyst forming effluent regeneration gases wherein an improvement comprises reducing emission of catalyst fines from said effluent regeneration gases while minimizing total catalyst losses in the process by recycling to said settling zone at least a portion of said decanted oil at a point located between the points of decanted oil and slurry-oil withdrawal at conditions including regulation of rate of recycle of the decanted oil to maintain the upward velocity in said settling zone at a rate so as to reject from said settling zone in said decanted oil catalyst particles of less than about 20 microns diameter.

7. The process of claim 6 further characterized in that upward velocity in said settling zone is regulated at a rate in the range of from about 0.1 to about 1 inch per minute.

* * * * *